US009540137B2

(12) United States Patent
Forrest et al.

(10) Patent No.: US 9,540,137 B2
(45) Date of Patent: Jan. 10, 2017

(54) CAN END WITH REINFORCING BEAD

(71) Applicant: Rexam Beverage Can Company, Chicago, IL (US)

(72) Inventors: Randall G. Forrest, Park Ridge, IL (US); Timothy L. Turner, Port Charlotte, FL (US)

(73) Assignee: REXAM BEVERAGE CAN COMPANY, Broomfield, CO (US)

( * ) Notice: Subject to any disclaimer, the term of this patent is extended or adjusted under 35 U.S.C. 154(b) by 0 days.

(21) Appl. No.: 14/641,646

(22) Filed: Mar. 9, 2015

(65) Prior Publication Data

US 2015/0175296 A1 Jun. 25, 2015

Related U.S. Application Data

(62) Division of application No. 11/837,175, filed on Aug. 10, 2007, now Pat. No. 8,973,780.

(51) Int. Cl.

| | |
|---|---|
| ***B65D 17/34*** | (2006.01) |
| ***B65D 6/40*** | (2006.01) |
| ***B65D 17/00*** | (2006.01) |

(52) U.S. Cl.

CPC ..... *B65D 7/40* (2013.01); *B65D 17/161* (2013.01); *B65D 2517/0014* (2013.01); *B65D 2517/0062* (2013.01); *B65D 2517/0089* (2013.01)

(58) Field of Classification Search

CPC . B65D 7/40; B65D 17/161; B65D 2517/0014; B65D 2517/0089; B65D 2517/0062; B65D 25/02; B65D 81/3216; B65D 17/08; B65D 7/36; B65D 7/44

USPC ..... 220/715, 623, 619

See application file for complete search history.

(56) References Cited

U.S. PATENT DOCUMENTS

| | | | |
|---|---|---|---|
| 3,186,583 | A | 6/1965 | Zundel |
| 3,434,623 | A | 3/1969 | Cookson |
| 3,525,455 | A | 8/1970 | Saunders |
| 3,705,563 | A | 12/1972 | Elser |
| 3,765,352 | A | 10/1973 | Schubert et al. |
| 3,837,524 | A | 9/1974 | Schubert et al. |
| 3,853,080 | A | 12/1974 | Zundel |
| 3,868,919 | A | 3/1975 | Schrecker et al. |
| 3,871,314 | A | 3/1975 | Stargell |

(Continued)

FOREIGN PATENT DOCUMENTS

| | | |
|---|---|---|
| AU | 107340 | 5/1939 |
| DE | 2303943 | 5/1974 |

(Continued)

OTHER PUBLICATIONS

European Patent Office, International Search Report mailed Oct. 13, 2008 in PCT Application No. PCT/US2008/072593.

(Continued)

*Primary Examiner* — Stephen Castellano

(74) *Attorney, Agent, or Firm* — Greer, Burns & Crain, Ltd.

(57) ABSTRACT

A can end for a two-piece beverage can is described. The can end has a center panel positioned about a vertical center axis. The center panel has a means for opening the can end located on a public side. A circumferential strengthening member is located about the center panel. A wall extends upwardly from the circumferential strengthening member. A curl is joined to an upper end of the wall. The curl defines an outer perimeter of the can end. A reinforcing bead is located on the wall between an uppermost portion of the wall and a lowermost portion of the wall.

8 Claims, 7 Drawing Sheets

(56) References Cited

U.S. PATENT DOCUMENTS

| | | | |
|---|---|---|---|
| 3,905,513 | A | 9/1975 | Klein |
| 3,941,277 | A | 3/1976 | McKinney et al. |
| 3,945,334 | A | 3/1976 | Ostrem et al. |
| 3,990,376 | A | 11/1976 | Schubert et al. |
| 4,031,837 | A | 6/1977 | Jordan |
| 4,055,134 | A | 10/1977 | Ostrem et al. |
| 4,084,721 | A | 4/1978 | Perry |
| 4,093,102 | A | 6/1978 | Kraska |
| 4,116,361 | A | 9/1978 | Stargell |
| 4,217,843 | A | 8/1980 | Kraska |
| 4,262,815 | A | 4/1981 | Klein |
| 4,324,343 | A | 4/1982 | Moller |
| 4,386,713 | A | 6/1983 | Baumeyer et al. |
| 4,434,641 | A | 3/1984 | Nguyen |
| 4,448,322 | A | 5/1984 | Kraska |
| 4,571,978 | A | 2/1986 | Taube et al. |
| 4,577,774 | A | 3/1986 | Nguyen |
| 4,641,761 | A | 2/1987 | Smith et al. |
| 4,680,917 | A | 7/1987 | Hambleton et al. |
| 4,685,849 | A | 8/1987 | LaBarge et al. |
| 4,704,887 | A | 11/1987 | Bachmann et al. |
| 4,722,215 | A | 2/1988 | Taube |
| 4,804,106 | A | 2/1989 | Saunders |
| 4,832,223 | A | 5/1989 | Kalenak et al. |
| 4,991,735 | A | 2/1991 | Biondich |
| 5,069,355 | A | 12/1991 | Matuszak |
| 5,105,977 | A | 4/1992 | Taniuchi |
| 5,143,504 | A | 9/1992 | Braakman |
| 5,149,238 | A | 9/1992 | McEldowney |
| 5,174,706 | A | 12/1992 | Taniuchi |
| 5,346,087 | A | 9/1994 | Klein |
| 5,538,744 | A | 7/1996 | Miller et al. |
| 5,823,730 | A | 10/1998 | La Rovere |
| 5,950,858 | A | 9/1999 | Sergeant |
| 5,964,366 | A | 10/1999 | Hurst et al. |
| 6,024,239 | A | 2/2000 | Turner et al. |
| 6,065,634 | A | 5/2000 | Brifcani et al. |
| 6,089,072 | A | 7/2000 | Fields |
| 6,234,337 | B1 | 5/2001 | Huber |
| 6,330,954 | B1 | 12/2001 | Turner et al. |
| 6,419,110 | B1 | 7/2002 | Stodd |
| 6,460,723 | B2 | 10/2002 | Nguyen et al. |
| 6,499,622 | B1 | 12/2002 | Neiner |
| 6,516,968 | B2 | 2/2003 | Stodd |
| 6,561,004 | B1 | 5/2003 | Neiner et al. |
| 6,702,142 | B2 | 3/2004 | Neiner |
| 6,736,283 | B1 | 5/2004 | Santamaria et al. |
| 6,772,900 | B2 | 8/2004 | Turner et al. |
| 6,848,875 | B2 | 2/2005 | Brifcani et al. |
| 6,877,941 | B2 | 4/2005 | Brifcani et al. |
| 6,889,862 | B2 | 5/2005 | Vaughan |
| 6,935,826 | B2 | 8/2005 | Brifcani et al. |
| 7,004,345 | B2 | 2/2006 | Turner et al. |
| 7,036,348 | B2 | 5/2006 | McClung |
| 7,174,762 | B2 | 2/2007 | Turner et al. |
| 7,278,548 | B2 | 10/2007 | Rieck et al. |
| 2001/0037668 | A1 | 11/2001 | Fields |
| 2002/0050493 | A1 | 5/2002 | Ball et al. |
| 2002/0088500 | A1 | 7/2002 | Turner et al. |
| 2002/0158071 | A1 | 10/2002 | Chasteen et al. |
| 2003/0042258 | A1 | 3/2003 | Turner et al. |
| 2003/0121924 | A1 | 7/2003 | Stodd |
| 2003/0173367 | A1 | 9/2003 | Nguyen et al. |
| 2004/0065663 | A1 | 4/2004 | Turner et al. |
| 2004/0074911 | A1 | 4/2004 | Stodd |
| 2004/0140312 | A1 | 7/2004 | Neiner |
| 2004/0200838 | A1 | 10/2004 | Turner et al. |
| 2004/0206764 | A1 | 10/2004 | Gardiner |
| 2004/0211780 | A1 | 10/2004 | Turner et al. |
| 2004/0238546 | A1 | 12/2004 | Watson |
| 2005/0006388 | A1 | 1/2005 | Turner et al. |
| 2005/0006395 | A1 | 1/2005 | Reed |
| 2005/0029269 | A1 | 2/2005 | Stodd et al. |
| 2005/0115976 | A1 | 6/2005 | Watson |
| 2005/0247717 | A1 | 11/2005 | Brifcani et al. |
| 2005/0252922 | A1 | 11/2005 | Reed |
| 2006/0071005 | A1 | 4/2006 | Bulso |
| 2006/0096994 | A1 | 5/2006 | Turner et al. |

FOREIGN PATENT DOCUMENTS

| | | | |
|---|---|---|---|
| DE | 2554264 | | 6/1977 |
| DE | 8228681 | | 10/1983 |
| GB | 422052 | | 6/1934 |
| JP | 2001151232 | A | 6/2001 |
| JP | 2006-069570 | | 3/2006 |
| NL | 1013957 | C2 | 6/2001 |
| WO | 9637414 | A1 | 11/1996 |
| WO | 9834743 | A1 | 8/1998 |
| WO | 0141948 | A2 | 6/2001 |
| WO | 0200512 | A1 | 1/2002 |
| WO | 0243895 | A1 | 6/2002 |
| WO | 02057137 | A2 | 7/2002 |
| WO | 02057148 | A1 | 7/2002 |
| WO | 0268281 | A1 | 9/2002 |
| WO | 03016155 | A1 | 2/2003 |
| WO | 03059764 | A1 | 7/2003 |
| WO | 2005113351 | A1 | 12/2005 |
| WO | 2005113352 | A1 | 12/2005 |
| WO | 2007005564 | A2 | 1/2007 |

OTHER PUBLICATIONS

Korean Intellectual Property Office, English Translation of Notice of Provisional Rejection, Mar. 2012, in Korean Application No. 10-2010-7005332.

CAN END WITH REINFORCING BEAD

CROSS-REFERENCE TO RELATED APPLICATIONS

This Application is a divisional of application Ser. No. 11/837,175 filed on Aug. 10, 2007, now U.S. Pat. No. 8,973,780. The Applications are commonly assigned and incorporated by reference herein.

TECHNICAL FIELD

The invention relates to can ends for two-piece beverage containers. More particularly, the present invention relates to such a can end having an annular reinforcing bead located on a circumferential wall.

BACKGROUND OF THE INVENTION

Common easy open end closures for beer and beverage containers have a central or center panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the remainder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin sheet of aluminum or steel. End closures, or can ends, for such containers are also typically constructed from a cut-edge of thin sheet of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

One goal of the can end manufacturers is to provide a buckle resistant end. Another goal of the manufacturers of can ends is to reduce the amount of metal in the blank which is provided to form the can end while at the same time maintaining the strength of the end. A number of disclosures, including U.S. Pat. Nos. 6,736,283, 6,460,723, 6,516,968, 6,419,110, 6,065,634, 6,848,875, 6,877,941, 6,935,826, 6,561,004, 6,499,622, 6,702,142, 7,100,789, 7,341,162, 7,380,684, 7,591,392, 7,819,275, 8,328,041, 8,490,825, and US Publication Nos. 2003/0121924, 2004/0238546, 2004/0140312, and 2002/0158071, are directed to achieving these goals by altering the angles and/or orientations of the chuck wall.

For example, U.S. Pat. No. 6,065,634 describes a can end having an annular reinforcing bead and an angled chuckwall to improve strength. The annular reinforcing bead, often called an anti-peaking bead or a countersink, has been described in many publications as a method of strengthening a can end.

Other publications have described the use of embossed or debossed beads to improve strength of can ends. For example, U.S. Pat. No. 6,889,862 describes a reinforcing cent bead located near the rivet. U.S. Pat. No. 6,330,954 described deboss and emboss tear panel stiffening beads.

The present invention is provided to solve the problems discussed above and other problems, and to provide advantages and aspects not provided by prior can ends of this type. A full discussion of the features and advantages of the present invention is deferred to the following detailed description, which proceeds with reference to the accompanying drawings.

SUMMARY OF THE INVENTION

One aspect of the present invention provides a can end for a two-piece beverage can. The can end comprises a center panel, a wall, a circumferential strengthening member, a curl, and a reinforcing bead. The center panel is positioned about a vertical center axis and includes a means for opening the can end located on a public side. The circumferential strengthening member is located about the center panel. The wall extends upwardly from the circumferential strengthening member. The curl is joined to an upper end of the wall and defines an outer perimeter of the can end. The reinforcing bead is located on the wall between an uppermost portion of the wall and a lowermost portion of the wall.

In one embodiment of the invention, the reinforcing bead extends radially inwardly relative to the vertical center axis of the can end. The reinforcing bead may be concave, and/or it may have a depth which is substantially less than a length of the wall.

In another embodiment, the reinforcing bead extends radially outwardly relative to the vertical axis of the can end. The reinforcing bead may be convex, and/or it may have a radially outermost portion having a greater distance from the vertical center axis than a distance of a radially innermost portion of the wall to the center vertical axis.

In another embodiment, the reinforcing bead has a radially outermost portion having a distance from the vertical center less than a distance of a radially outermost portion of the wall to the vertical axis.

In another embodiment, the reinforcing bead is an annular reinforcing bead.

In another embodiment, the reinforcing bead has a lower end joined to an upper end by an arcuate segment. The upper end of the reinforcing bead is located radially outwardly of the lower end.

In another embodiment, the strengthening member is a countersink. The countersink may be U-shaped.

In another embodiment, the strengthening member is a fold. The fold may have a first end joined to an outer peripheral edge of the center panel. The first end is joined to a second end by an intermediate segment. The intermediate segment extends upwardly and outwardly relative to the vertical center axis. The intermediate segment may have a vertical extent having a height greater than or equal to a height of the first end.

In another embodiment, the reinforcing bead has a substantially semi-elliptical cross-section. The reinforcing bead may be convex or concave.

Another aspect of the invention is also directed to a can end for a two-piece beverage can. This can end comprises a center panel, an annular strengthening member, a wall, a curl, and a convex reinforcing bead. The center panel is positioned about a vertical center axis, and has a means for opening the center panel located on a public side of the center panel. The annular strengthening member is located about the center panel, and has a first end joined to an outer peripheral edge of the center panel. The wall has a lowermost portion joined to a second end of the strengthening member. The wall extends upwardly and outwardly relative to the vertical center axis. The curl defines a perimeter of the can end. The curl has an innermost portion joined to an uppermost portion of the wall. The convex reinforcing bead is located on the wall between the upper most portion of the wall and the lowermost portion of the wall.

Another aspect of the invention is also directed to a can end for a two-piece beverage can. This can end comprises a center panel, an annular strengthening member, a wall, a curl, and a concave reinforcing bead. The center panel is positioned about a vertical center axis, and has a means for opening the center panel located on a public side of the center panel. The annular strengthening member is located about the center panel, and has a first end joined to an outer peripheral edge of the center panel. The wall has a lowermost portion joined to a second end of the strengthening member. The wall extends upwardly and outwardly relative to the vertical center axis. The curl defines a perimeter of the can end. The curl has an innermost portion joined to an uppermost portion of the wall. The concave reinforcing bead is located on the wall between the upper most portion of the wall and the lowermost portion of the wall.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
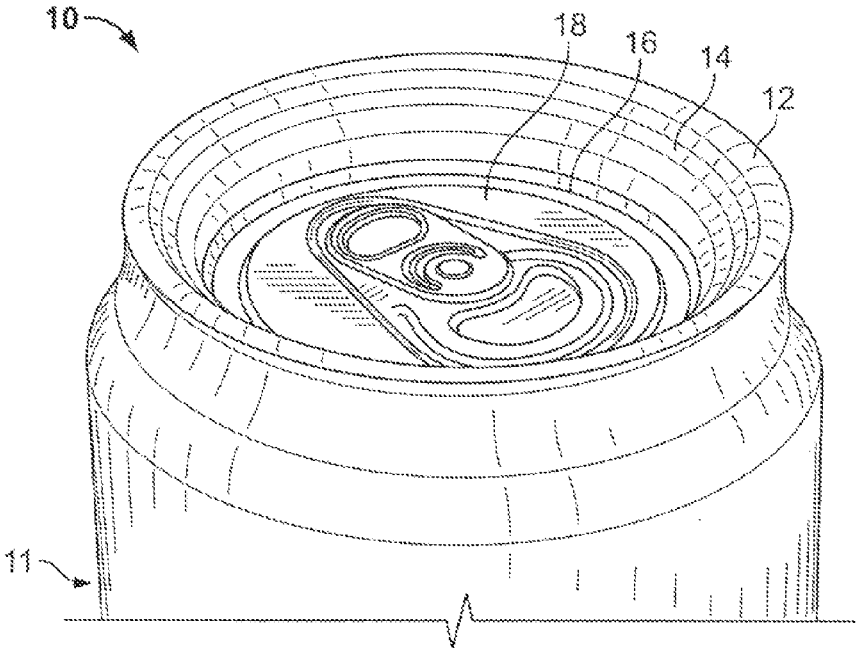
FIG. 1 is a partial perspective view of a can end of the present invention seamed to a can body to form a two-piece beverage container.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a can end for a two-piece beverage can. The container end of the present invention is a stay-on-tab end member with improved physical properties including strength. The can end of the present invention has a novel reinforcing bead located on a circumferential wall. It is believed that such a reinforcing bead improves the overall strength of the can end. Therefore, can ends of the present invention can be produced from a lower volume of metal, in cut-edge, thickness, or both, than previously designed can ends covering the same can body opening. Essentially, the present invention provides a lightweight end member which embodies the physical characteristics and properties required in the beverage container market, as explained below.

Figure 2:
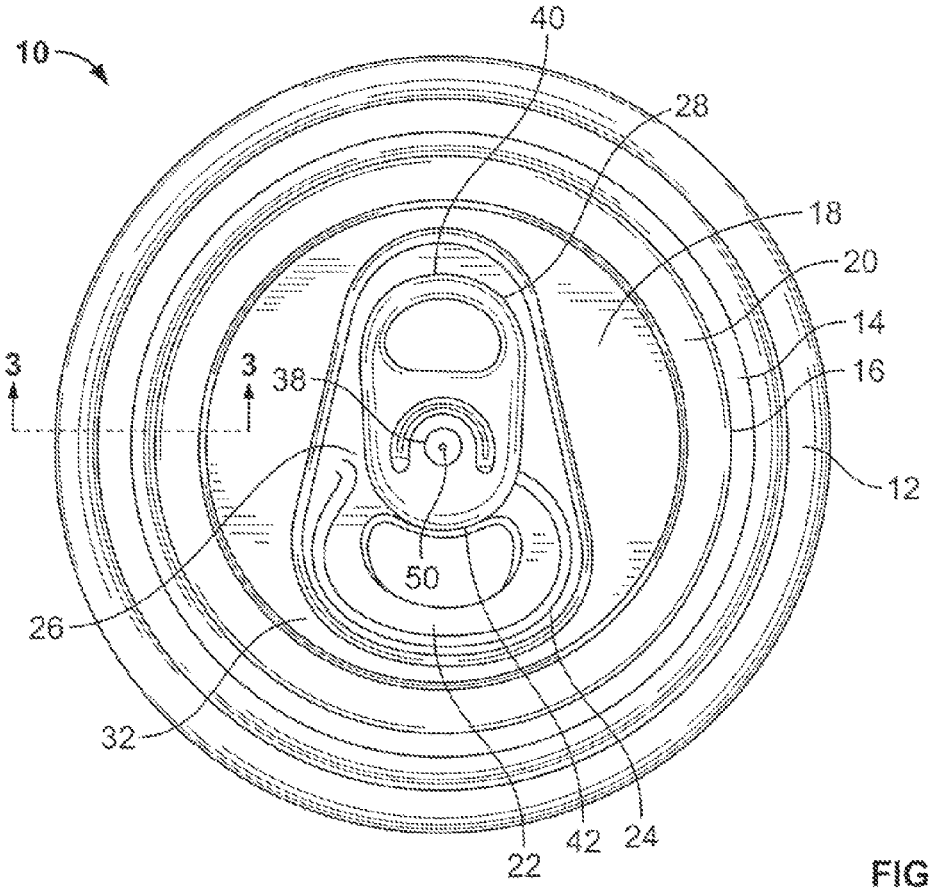
FIG. 2 is a top view of a can end of the present invention.
Figure 3:
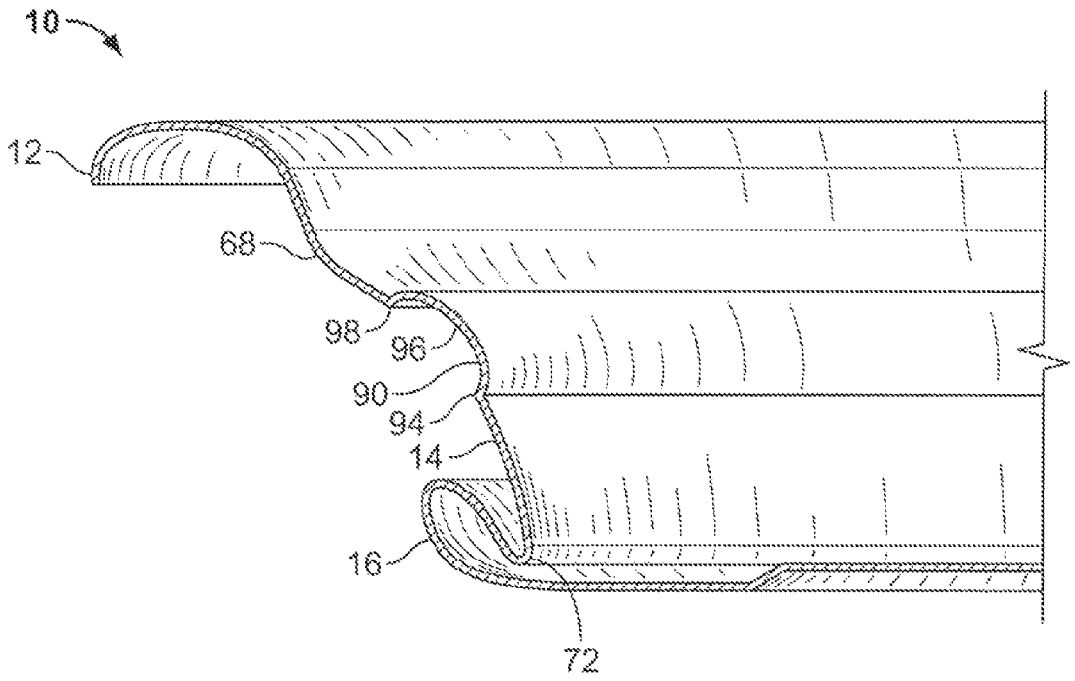
FIG. 3 is a cross-sectional view of a can end of the present invention having a convex reinforcing bead located on a circumferential wall.
Figure 4:
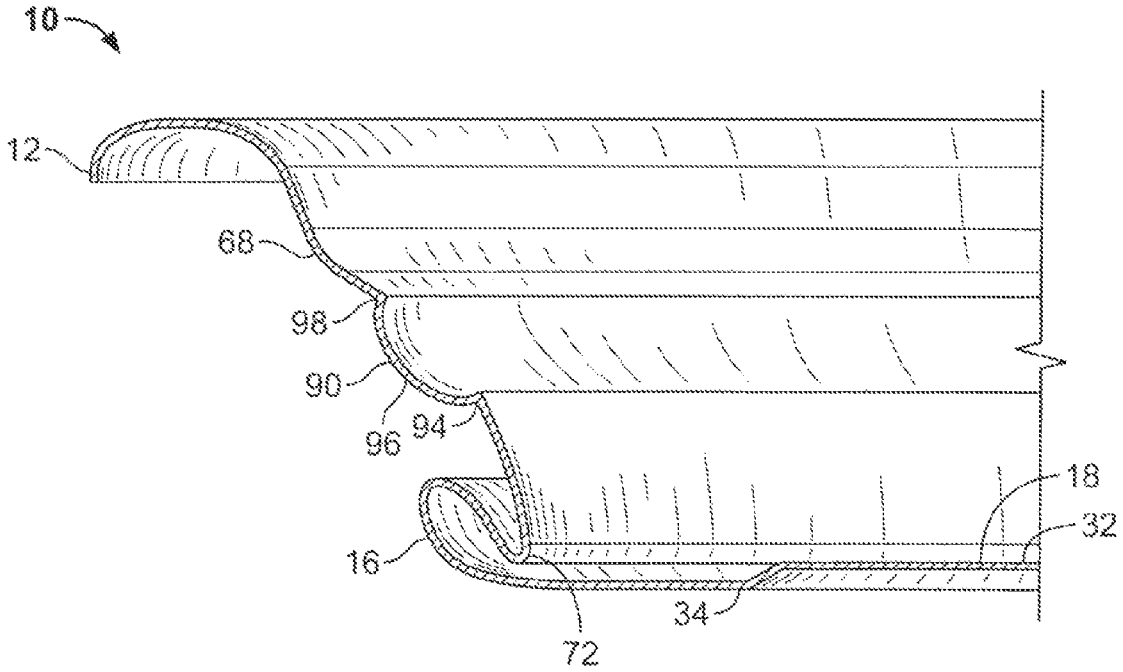
FIG. 4 is a cross-sectional view of a can end of the present invention having a concave reinforcing bead located on a circumferential wall.
Figure 5:
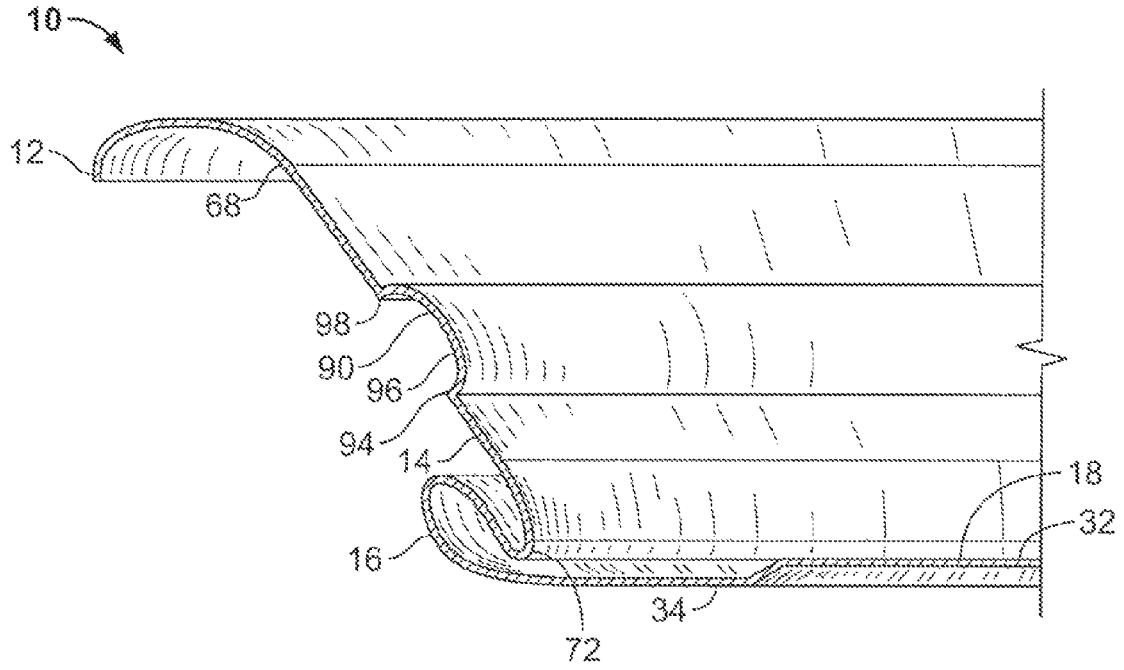
FIG. 5 is a cross-sectional view of a can end of the present invention having a convex reinforcing bead located on a circumferential wall.
Figure 6:
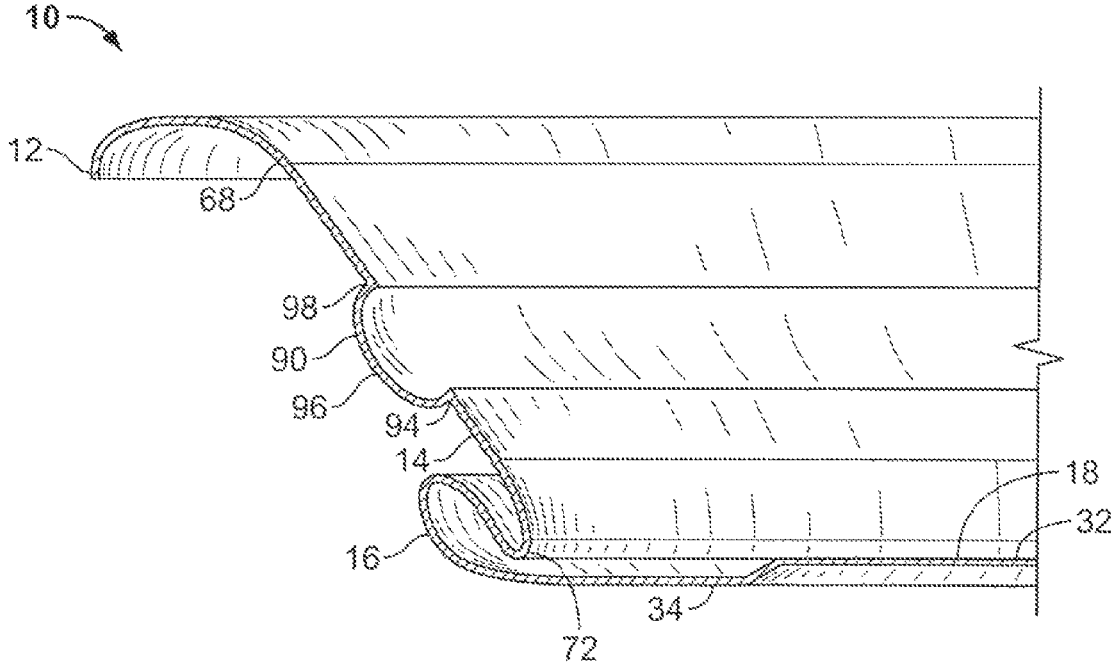
FIG. 6 is a cross-sectional view of a can end of the present invention having a concave reinforcing bead located on a circumferential wall.
Figure 7:
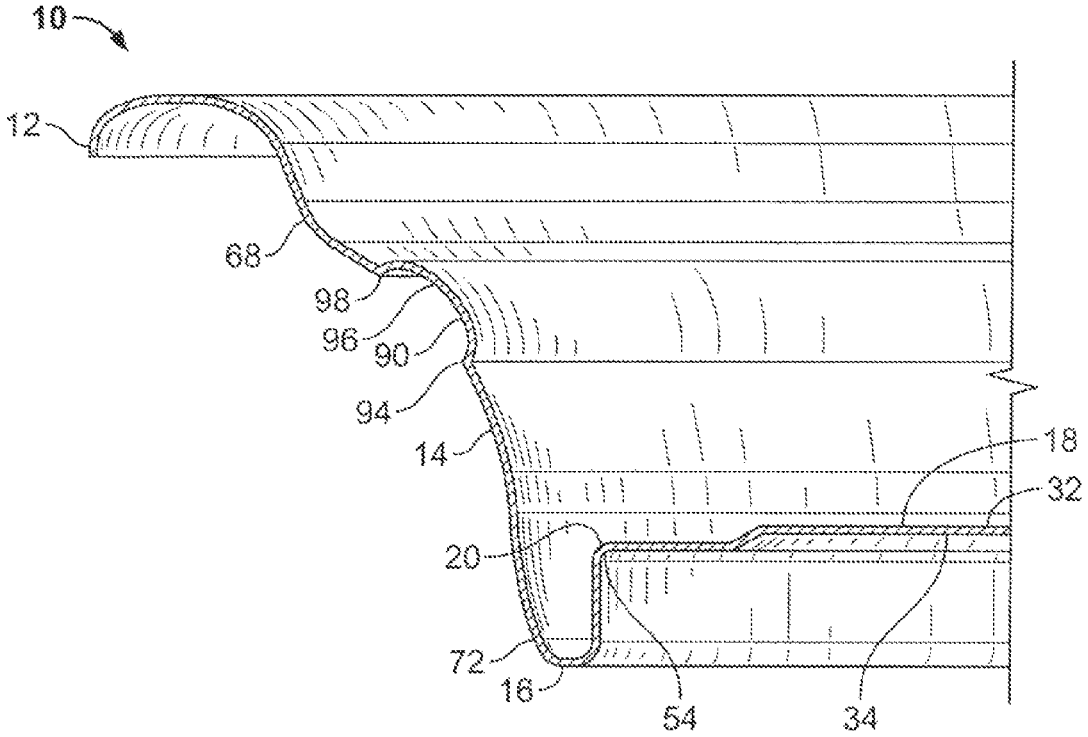
FIG. 7 is a cross-sectional view of a can end of the present invention having a convex reinforcing bead located on a circumferential wall.
Figure 8:
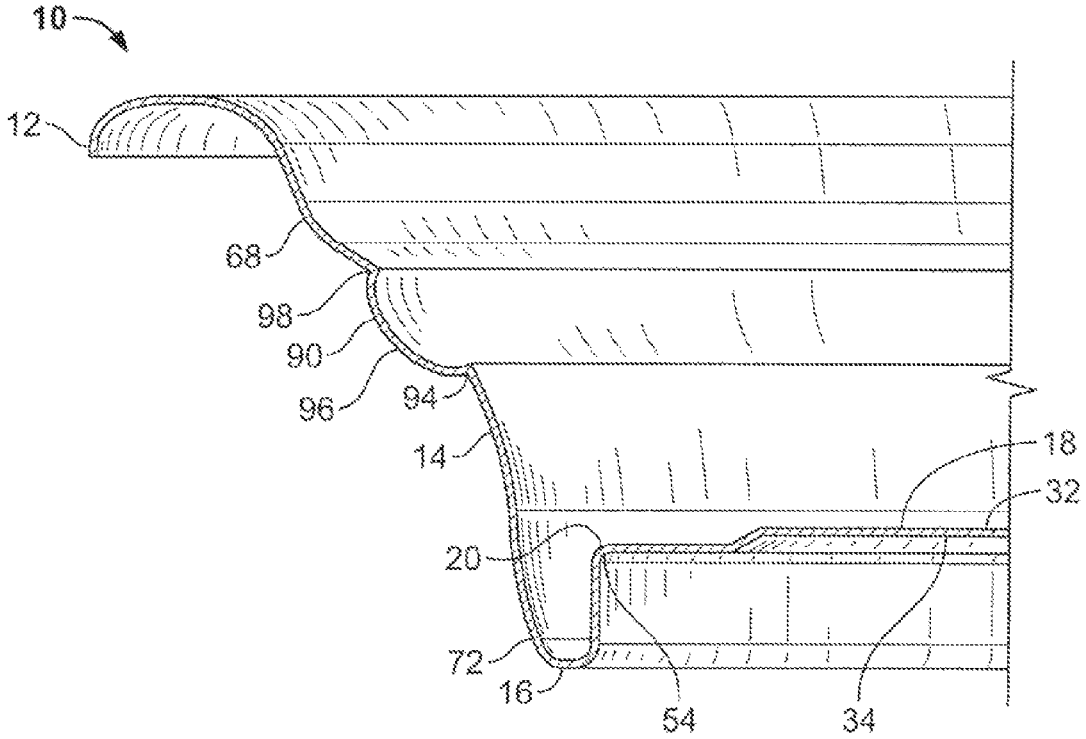
FIG. 8 is a cross-sectional view of a can end of the present invention having a concave reinforcing bead located on a circumferential wall.
Figure 9:
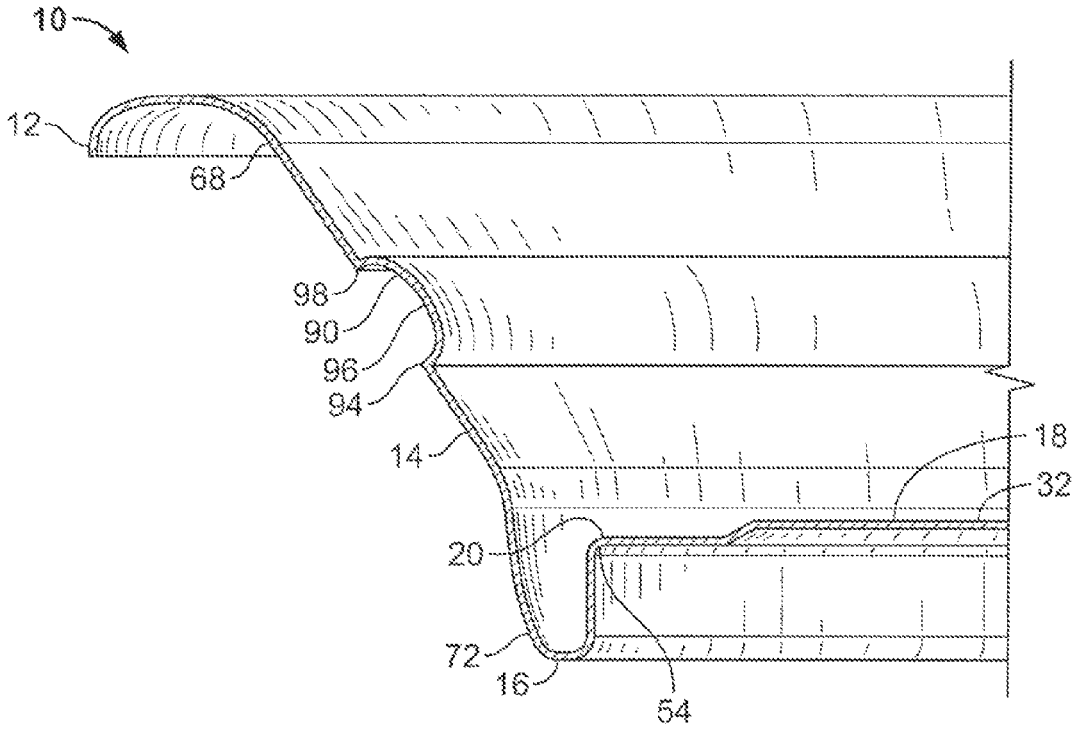
FIG. 9 is a cross-sectional view of a can end of the present invention having a convex reinforcing bead located on a circumferential wall.
Figure 10:
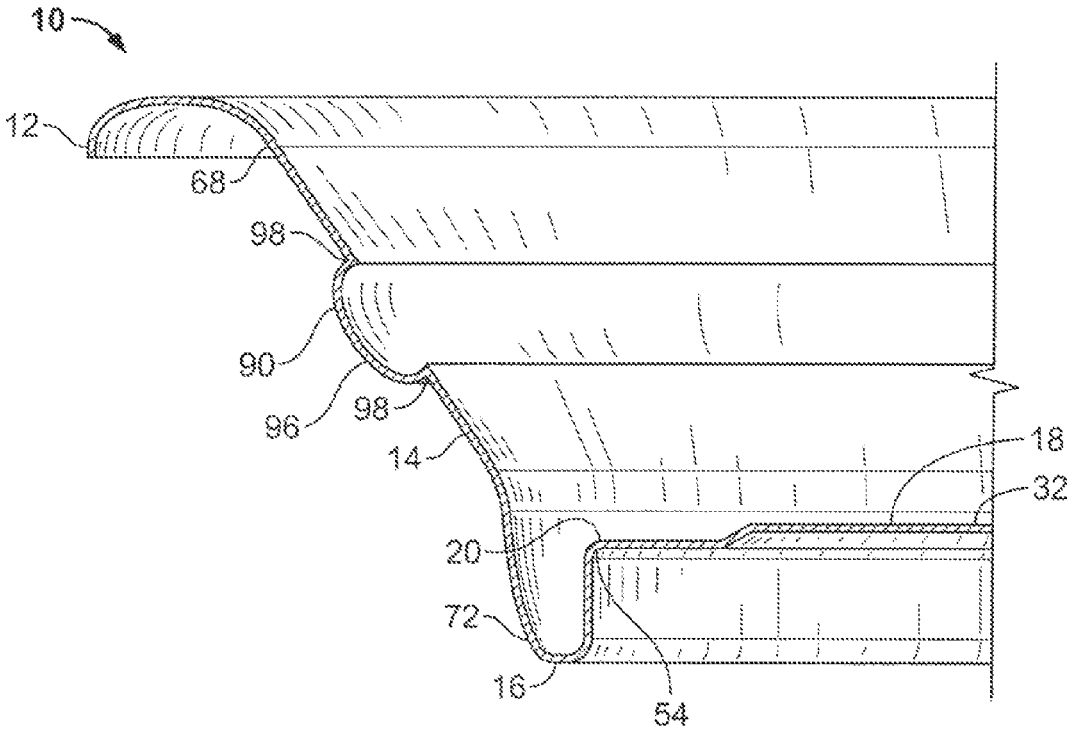
FIG. 10 is a cross-sectional view of a can end of the present invention having a concave reinforcing bead located on a circumferential wall.

Referring to FIGS. 1 and 2, the end member 10 for a container 11 has a curl 12, a circumferential wall 14, an annular strengthening member 16, and a center or central panel wall 18. As illustrated in FIGS. 1-6, the strengthening member 16 is a fold. However, as illustrated in FIGS. 7-10, the strengthening member may be a U-shaped annular reinforcing bead, often called a countersink.

As illustrated in FIGS. 1-6, the fold typically has a first end joined to an outer peripheral edge of the center panel joined to a second end by an intermediate segment. The intermediate segment extends upwardly and outwardly relative to a vertical center axis 50. The intermediate segment has a vertical extent having a height greater than or equal to a height of the first end. The second end is joined to the circumferential wall 14

The container is typically a drawn and ironed metal can such as the common beer and beverage containers, usually constructed from a thin sheet of aluminum or steel that is delivered from a large roll called coil stock of roll stock. End closures for such containers are also typically constructed from a cut edge of thin sheet of aluminum or steel delivered from coil stock, formed into blank end, and manufactured into a finished end by a process often referred to as end conversion. In the embodiment shown in the figures, the end member 10 is joined to a container by the curl 12 which is joined to a mating curl of the container body. The seaming curl 12 of the end closure 10 is integral with the circumferential wall 14 which is joined to a radially outer peripheral edge portion 20 of the center panel 18 by the annular strengthening member 16. This type of means for joining the end member 10 to a container body is presently the typical means for joining used in the industry, and the structure described above is formed in the process of forming the blank end from a cut edge of metal sheet, prior to the end conversion process. However, other means for joining the end member 10 to a container may be employed with the present invention.

The center panel 18 has a means for opening the end 10. The means for opening the end 10 may include a displaceable foil closure member or, as shown in FIGS. 1 and 2, a tear panel 22 defined by a curvilinear frangible score 24 and a non-frangible hinge segment 26. The hinge segment 26 is defined by a generally straight line between a first end and a second end of the frangible score 24. The tear panel 22 of the center panel 18 may be opened, that is the frangible score 24 may be severed and the tear panel 22 displaced at an angular orientation relative to the remaining portion of the center panel 18, while the tear panel 22 remains hingedly connected to the center panel 18 through the hinge segment 26. In this opening operation, the tear panel 22 is displaced at an angular deflection, as it is opened by being displaced away from the plane of the panel 18.

The frangible score 24 is preferably a generally V-shaped groove formed into a public side 32 of the center panel 18. A residual is formed between the V-shaped groove and a product side 34 of the end member 10.

The end member 10 has a tab 28 secured to the center panel 18 adjacent the tear panel 22 by a rivet 38. The rivet 38 is formed in the typical manner.

During opening of the end member 10 by the user, the user lifts a lift end 40 of the tab 28 to displace a nose portion 42 downward against the tear panel 22. The force of the nose portion 42 against the tear panel 22 causes the score 24 to fracture. As the tab 28 displacement is continued, the fracture of the score 24 propagates around the tear panel 22, preferably in progression from the first end of the score 24 toward the second end 30 of the score 24.

Referring to FIG. 2, the center panel 18 is centered about a vertical center or longitudinal axis 50. The curl 12 defines an outer perimeter of the end member 10 and is integral with the circumferential wall 14. The circumferential wall 14 extends downwardly from the curl 12 at an angle, typically between 10 and 60 degrees. The circumferential wall 14 may be provided with a radius of curvature as shown in FIGS. 3-4 and 7-8 to improve performance within the forming tools used to form the end member 10. The radius of curvature helps prevent buckling within the tools as force is applied to the unfinished end member 10.

The annular strengthening member 16 extends circumferentially about the center panel 18. One or more panel radii 54 join the radially outer peripheral edge 20 of the center panel 18 to the annular strengthening member 16.

The circumferential wall 14 joins the annular strengthening member 16 with the curl 12 so that an uppermost portion 68 of the wall 14 is directly connected to the curl 12 and a lowermost portion 72 of the wall 14 is directly connected to an end of the strengthening member 16. As illustrated in FIGS. 3-4 and 7-8, the curl is extended downwardly almost to the vertically upper extent of a reinforcing bead 90. Accordingly, the circumferential wall 14 extends upwardly from the annular strengthening member 16. The circumferential wall 14 may be angled outwardly relative to the longitudinal axis 50 or have an arcuate segment.

As illustrated in FIGS. 3-4 and 7-8, the curl 12 is extended downwardly almost to the vertically upper extent of a reinforcing bead 90, only separated from the bead 90 by a short angled segment of the circumferential wall 14.

As illustrated in FIGS. 5-6 and 9-10, the curl 12 is separated from the bead 90 by a flat, angled portion of the circumferential wall 14.

The present invention provides the reinforcing bead 90 between the upper and lower ends 68,72 of the circumferential wall 14. Prior art can ends have used reinforcing beads at various locations along the center panel to provide strength and stiffen the center panel 18. In fact, the annular countersink is often referred to as a bead, reinforcing bead, anti-peaking bead, etc. Up until now, however, it is believed that an annular bead 90 has not been located on the circumferential wall 14 to improve performance of the can end 10. The term "bead" is intended to include any narrow concave or convex groove.

Thus, the reinforcing bead 90 is located between the curl 12 and the strengthening member 16. The reinforcing bead 90 is preferably circumferential and may be directed radially inwardly and convex (embossed) as shown in FIGS. 3, 5, 7, and 9 or radially outwardly and concave (debossed) as shown in FIGS. 4, 6, 8 and 10. The reinforcing bead 90 is located on the wall 14 between an uppermost portion 68 of the wall and a lowermost 72 portion of the wall 14, and it is believed that the bead 90 increases the relative stiffness of the circumferential wall 14.

Referring to FIGS. 4, 6, 8, and 10, the reinforcing bead 90 has a three-part structure. A first bend 94 has a radius of curvature having a center point located below the profile of the can end 10. A main portion or center portion 96 is located above the first bend 94, preferably directly connected thereto. The center portion 96 is a curved segment which may be seen as an arcuate segment, an arc of a circle in cross-section. At least some portion of the center portion 96 has a radius of curvature having a center point located above the profile of the can end 10. A second bend 98 is joined to an opposite end of the center portion 96, preferably directly connected thereto. The second bend 98 has a radius of curvature having a center point below the profile of the can end. Preferably, the bead 90 is a segment of an ellipse, preferably substantially semi-elliptical, including segments of a circle.

Figure 12:
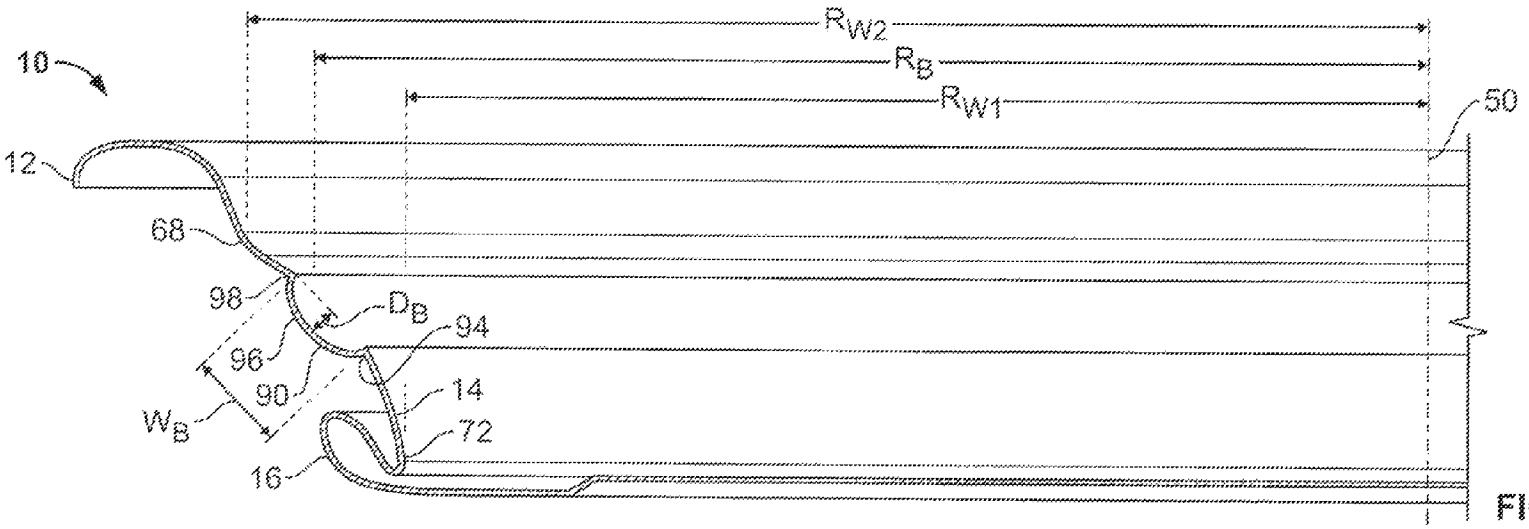
FIG. 12 is a partial cross-sectional view of a can end of the present invention, illustrating dimensional characteristics.
Figure 14:
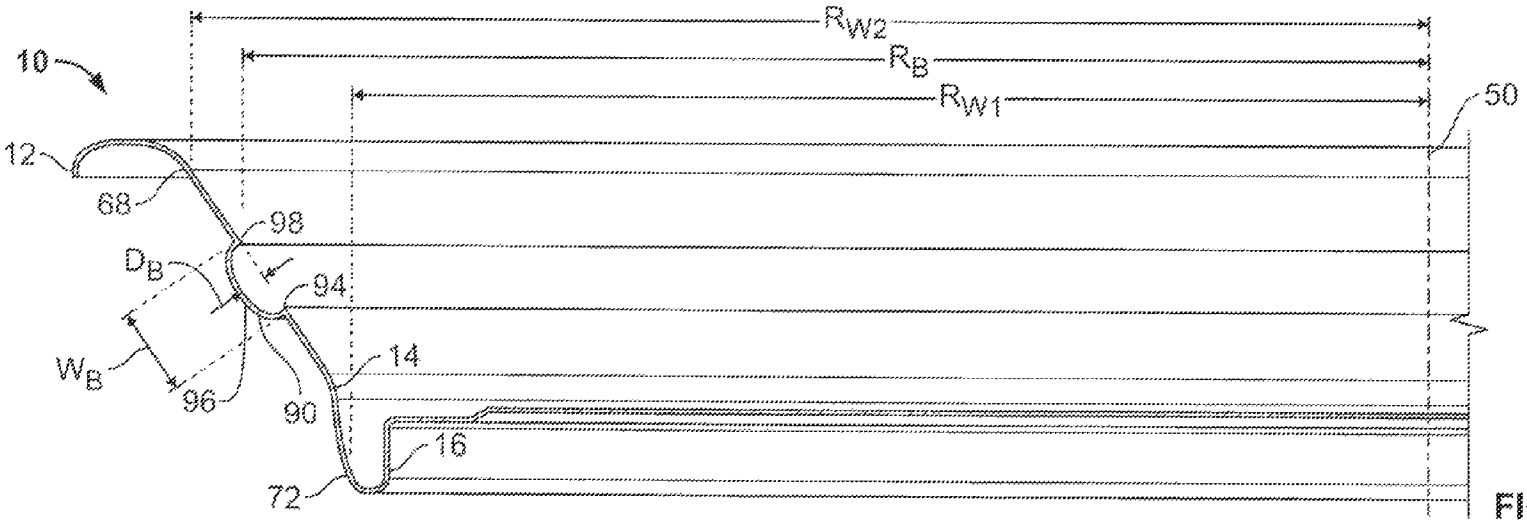
FIG. 14 is a partial cross-sectional view of a can end of the present invention, illustrating dimensional characteristics.

With further reference to FIGS. 12 and 14, bead 90 has a depth DB below the first and second bends 94,98 which is constant around the bead circumference and may be about 0.003 to 0.015 inches (0.076 mm to 0.38 mm) and preferably 0.004 to 0.010 inches (0.10 mm to 0.254 mm) and most preferably 0.005 to 0.008 inches (0.13 mm to 0.20 mm). The bead width WB between the first and second bends 94,98 may be about 0.046 inches (1.17 mm).

Figure 11:
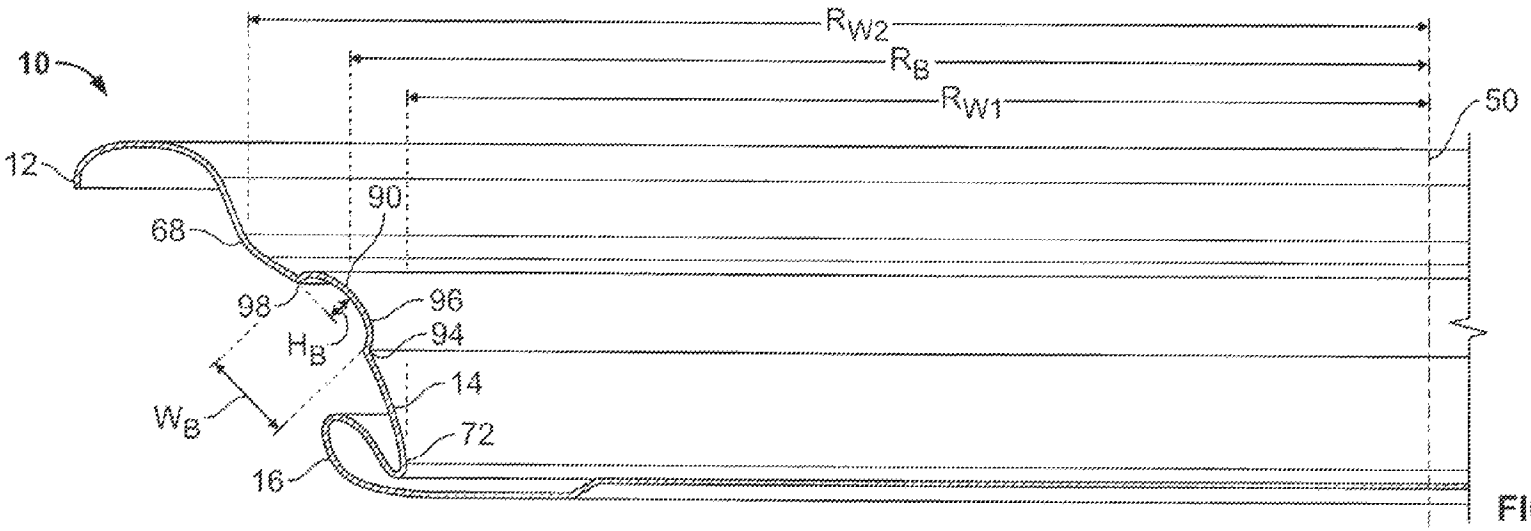
FIG. 11 is a partial cross-sectional view of a can end of the present invention, illustrating dimensional characteristics.
Figure 13:
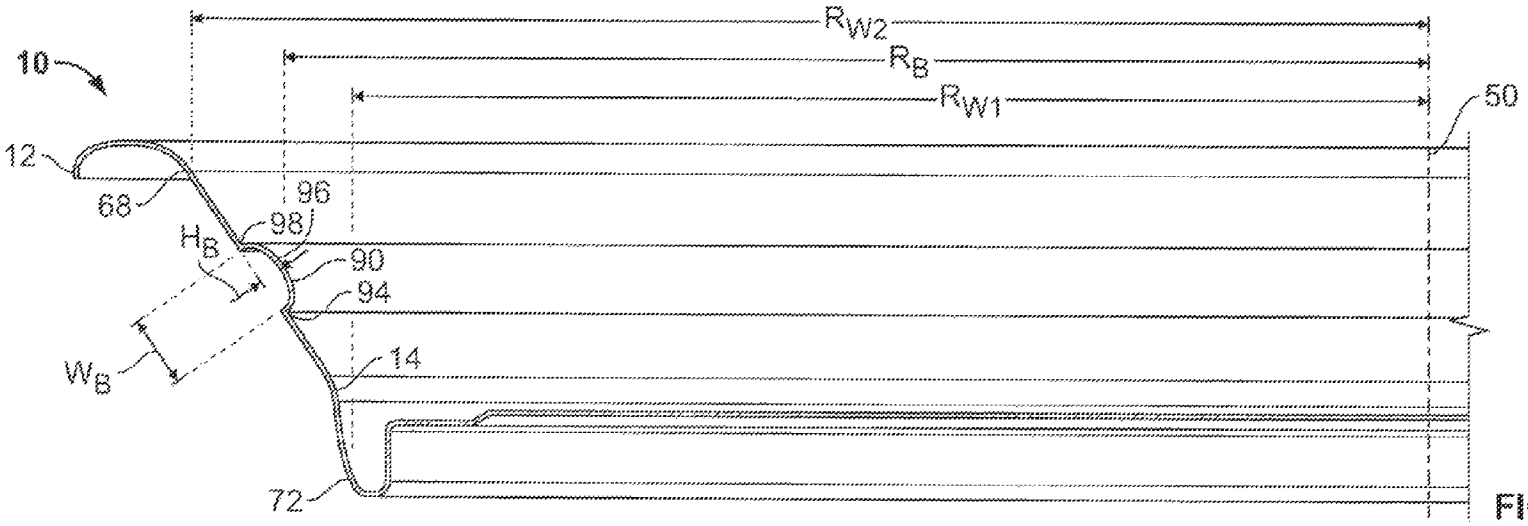
FIG. 13 is a partial cross-sectional view of a can end of the present invention, illustrating dimensional characteristics.

In another aspect of the invention, illustrated in FIGS. 11 and 13, wherein the reinforcing bead 90 is directed radially inwardly, the first bend 94 has a radius of curvature having a center point located above the profile of the can end. The main portion or center portion 96 is located above the first bend 94. At least some portion of the center portion 96 has a radius of curvature having a center point located below the profile of the can end 10. The second bend 98 has a radius of curvature having a center point above the profile of the can end.

The bead center portion 96 which may have a height HB above a straight line connecting the first and second bends 94,98 which is constant around the bead circumference and may be about 0.003 to 0.015 inches (0.076 mm to 0.38 mm) and preferably 0.004 to 0.010 inches (0.10 mm to 0.254 mm) and most preferably 0.005 to 0.008 inches (0.13 mm to 0.20 mm) The bead 96 width WB between the first and second bends 94,98 may be about 0.046 inches (1.17 mm).

Referring to FIGS. 11-14, preferably, from a relative standpoint, the radii of curvature of the first bend and second bend 94,98 are less than the radius of curvature of the center portion 96 The maximum distance DB, HB from a straight line connecting the first and second bends 94,98 to the center portion 96 is substantially less than a length of the circumferential wall 14. Preferably, this maximum distance DB, HB is less than a distance from the first bend 94 to the second bend 98. Further, the center portion 96 at its deepest point is located at a distance $R_B$ from the center vertical axis 50 which is greater than a distance $R_{W1}$ from the vertical center axis 50 of a radially innermost portion of the circumferential wall 14. In addition, the distance $R_B$ is less than a distance $R_{W2}$ from the center vertical axis 50 of a radially outermost portion of the wall 14. Most preferably, the reinforcing bead 90 has a lower end joined to an upper end by an arcuate segment wherein the upper end of the reinforcing bead 90 is located radially outwardly of the lower end. As shown, preferably, the bead 90 has a radially innermost portion that is located radially outwardly of the lowermost portion of the wall 14.

The terms "first," "second," "upper," "lower," etc. are used for illustrative purposes only and are not intended to limit the embodiments in any way. The term "plurality" if used herein is intended to indicate any number greater than one, either disjunctively or conjunctively as necessary, up to an infinite number. The terms "joined" and "connected" as used herein are intended to put or bring two elements together so as to form a unit, and any number of elements, devices, fasteners, etc. may be provided between the joined or connected elements unless otherwise specified by the use of the term "directly" and supported by the drawings.

While the specific embodiments have been illustrated and described, numerous modifications come to mind without significantly departing from the spirit of the invention, and the scope of protection is only limited by the scope of the accompanying Claims.

What is claimed is:

1. A can end for a two-piece beverage can, the can end comprising:

a center panel positioned about a vertical center axis, the center panel comprising:

a tear panel defined by a curvilinear frangible score and a non-frangible hinge segment; and a tab secured to the center panel adjacent the tear panel by a rivet intersecting the vertical center axis;

a circumferential countersink located about the center panel;

a wall extending upwardly from the circumferential countersink;

a curl joined to an upper end of the wall, the curl defining an outer perimeter of the can end; and a reinforcing bead located on the wall between an uppermost portion of the wall and a lowermost portion of the wall;

wherein the reinforcing bead extends radially inwardly towards the vertical center axis of the can end and wherein a radially innermost portion of the reinforcing bead is located radially outwardly from a nose end of the tab overlying the tear panel, wherein a radially innermost portion of the wall is spaced radially inwardly of the reinforcing bead.

2. The can end of claim 1 wherein the reinforcing bead has a depth, the depth being substantially less than a length of the wall.

3. The can end of claim 1 wherein the reinforcing bead is convex.

4. The can end of claim 1 wherein the countersink is U-shaped.

5. The can end of claim 1 wherein the reinforcing bead has a substantially semi-elliptical cross-section.

6. The can end of claim 5 wherein the reinforcing bead is convex.

7. A can end for a two-piece beverage can, the can end comprising:

a center panel positioned about a vertical center axis, the center panel comprising:

a tear panel defined by a curvilinear frangible score and a non-frangible hinge segment; and a tab secured to the center panel adjacent the tear panel by a rivet intersecting the vertical center axis;

an annular countersink located about the center panel, the annular countersink having a first end joined to an outer peripheral edge of the center panel;

a wall having a lowermost portion joined to a second end of the countersink, the wall extending upwardly and outwardly relative to the vertical center axis;

a curl defining a perimeter of the can end; the curl having an innermost portion joined to an uppermost portion of the wall; and a convex reinforcing bead located on the wall between the upper most portion of the wall and the lowermost portion of the wall wherein a radially innermost portion of the reinforcing bead is located radially outwardly from a nose end of the tab overlying the tear panel, wherein a radially innermost portion of the wall is spaced radially inwardly of the reinforcing bead.

8. The can end of claim 7 wherein the countersink is U-shaped.

* * * * *